United States Patent [19]

Chan et al.

[11] Patent Number: 4,917,986

[45] Date of Patent: Apr. 17, 1990

[54] PHOSPHOROUS-CONTAINING COMPOUNDS AS ADJUVANT FOR POSITIVE ELECTROSTATIC LIQUID DEVELOPERS

[75] Inventors: Dominic M. T. Chan, Wilmington; Torence J. Trout, Yorklyn, both of Del.

[73] Assignee: E. I. du Pont de Nemours and Company, Wilmington, Del.

[21] Appl. No.: 292,191

[22] Filed: Dec. 30, 1988

[51] Int. Cl.[4] ..... G03G 9/12

[52] U.S. Cl. ..... 430/115; 430/137

[58] Field of Search ..... 430/115, 119, 137

[56] References Cited

U.S. PATENT DOCUMENTS 4,014,856 3/1977 Gilliams et al. ..... 252/62.1

4,425,418 1/1984 Iwaki et al. ..... 430/106

4,734,352 3/1988 Mitchell ..... 430/115

*Primary Examiner*—John L. Goodrow

[57] ABSTRACT

A positive, liquid electrostatic developer consisting essentially of (A) a nonpolar liquid having a Kauri-butanol value of less than 30, present in a major amount, (B) thermoplastic resin particles having dispersed therein a phosphorous-containing compound defined herein which is substantially insoluble or immiscible in the nonpolar liquid at ambient temperatures, the resin particles having an average by area particle size of less than 10 μm, and (C) a nonpolar liquid soluble ionic or zwitterionic charge director compound, and process for preparation. The liquid developer is useful in copying, color proofing including digital color proofing, lithographic printing plates and resists.

53 Claims, No Drawings

PHOSPHOROUS-CONTAINING COMPOUNDS AS ADJUVANT FOR POSITIVE ELECTROSTATIC LIQUID DEVELOPERS

DESCRIPTION

Technical Field

This invention relates to electrostatic liquid developers. More particularly this invention relates to a positive-working liquid electrostatic developer containing resin particles having dispersed therein phosphorous-containing compounds.

Background of the Invention

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0, and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., aminoalcohols, polybutylene succinimide, an aromatic hydrocarbon, etc. to the liquid developer comprising the thermoplastic resin, dispersant nonpolar liquid and preferably a colorant. Such liquid developers provide images of good resolution, but it has been found that charging and image quality are particularly pigment dependent. Some formulations, suffer from poor image quality manifested by low resolution, poor solid area coverage (density), and/or image squash. Some developers, particularly those having a plurality of fibers integrally extending therefrom, are highly flocculated, and settle rapidly in the dispersion. In order to overcome such problems much research effort has been expended to develop new type charge directors and/or charging adjuvants for electrostatic liquid toners or developers.

It has been found that the above disadvantages can be overcome and improved positive developers prepared containing a dispersant nonpolar liquid, ionic or zwitterionic charge director compound, a thermoplastic resin, and preferably a colorant, and a compound of this invention dispersed in the resin. The improved electrostatic liquid developer when used to develop an electrostatic image results in improved image quality, reduced squash, improved solid area coverage independent of the pigment and charge director compound present.

SUMMARY OF THE INVENTION

In accordance with this invention there is provided an improved positive electrostatic liquid developer having improved charging characteristics consisting essentially of (A) a nonpolar liquid having a Kauri-butanol value of less than 30, present in a major amount, (B) thermoplastic resin particles having dispersed therein a phosphorous containing compound which is substantially insoluble or immiscible in the nonpolar liquid at ambient temperatures and is selected from the group consisting of (1) polyphosphoric acids; (2) the +1 and +2 metal salts of said polyphosphoric acids; (3) phosphorous pentoxide; (4) pyrophosphate compounds of the general formula:

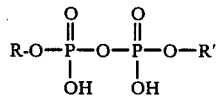

wherein R and R′, which can be the same or different are alkyl of 1 to 10 carbon atoms; (5) the +1 and +2 metal salts of said pyrophosphates; (6) phosphonic acids of the general formula:

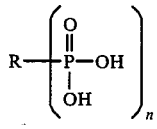

wherein R is alkyl of 1 to 30 carbon atoms and aryl of 6 to 30 carbon atoms, n is a whole number of 1 to 6; (7) the +1 and +2 metal salts of said phosphonic acids; (8) phosphate compounds of the general formula:

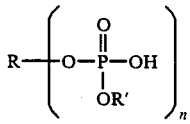

wherein R and R′, which can be the same or different, are H, alkyl of 1 to 30 carbon atoms and aryl of 6 to 30 carbon atoms, n is whole number of 1 to 6; and (9) the +1 and +2 metal salts of said phosphate compounds, the resin particles having an average by area particle size of less than 10 μm, and (C) a nonpolar liquid soluble ionic or zwitterionic charge director compound.

In accordance with an embodiment of this invention there is provided a process for preparing a positive electrostatic liquid developer for electrostatic imaging comprising (A) dispersing at an elevated temperature in a vessel a thermoplastic resin, a phosphorous-containing compound which is substantially insoluble or immiscible in a nonpolar liquid at ambient temperatures and is selected from the group consisting of (1) polyphosphoric acids; (2) the +1 and +2 metal salts of said polyphosphoric acids; (3) phosphorous pentoxide; (4) pyrophosphate compounds of the general formula:

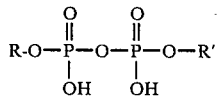

wherein R and R′, which can be the same or different are alkyl of 1 to 10 carbon atoms; (5) the +1 and +2 metal salts of said pyrophosphates; (6) phosphonic acids of the general formula:

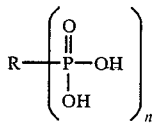

wherein R is alkyl of 1 to 30 carbon atoms and aryl of 6 to 30 carbon atoms, n is a whole number of 1 to 6; (7) the +1 and +2 metal salts of said phosphonic acids; (8) phosphate compounds of the general formula:

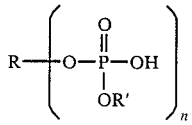

wherein R and R′, which can be the same or different, are H, alkyl of 1 to 30 carbon atoms and aryl of 6 to 30 carbon atoms, n is whole number of 1 to 6; and (9) the +1 and +2 metal salts of said phosphate compounds, a dispersant nonpolar liquid having a Kauri-butanol value of less than 30, and a colorant, while maintaining the temperature in the vessel at a temperature sufficient to plasticize and liquify the resin and below that at which the dispersant nonpolar liquid degrades and the resin and/or colorant decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the addition of additional liquid;

(C) separating the dispersion of toner particles having an average by area particle size of less than 10 μm from the particulate media, and (D) adding to the dispersion during or subsequent to Step (A) a nonpolar liquid soluble ionic or zwitterionic charge director compound.

DETAILED DESCRIPTION OF THE INVENTION

Throughout the specification the below-listed terms have the following meanings:

"Consisting essentially of" means the composition of the electrostatic liquid developer does not exclude unspecified components which do not prevent the advantages of the developer from being realized. For example, in addition to the primary components, there can be present additional components, such as a colorant, fine particle size oxides, adjuvant, e.g., aminoalcohol, polybutylene succinimide, aromatic hydrocarbon, etc.

Aminoalcohol means there is both an amino functionality and a hydroxyl functionality in one compound.

Q/m is the charge to mass ratio expressed as micro Coulombs/gram.

Conductivity is the conductivity of the developer measured in pmhos/cm at 5 hertz and 5 volts and can be referred to as BULK.

Grey Scale means a step wedge where the toned image density increases from Dmin to Dmax in constant increments.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (° C.) | Auto-Ignition Temp (° C.) |
|---|---|---|
| Norpar® 12 | 69 | 204 |
| Norpar® 13 | 93 | 210 |
| Norpar® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, and any pigment component present.

Useful thermoplastic resins or polymers include: ethylene vinyl acetate (EVA) copolymers (Elvax® resins, E. I. du Pont de Nemours and Company, Wilmington, Del.), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, Del., etc., or blends thereof, polyesters, polyvinyl toluene, polyamides, styrene/-butadiene copolymers and epoxy resins. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

The thermoplastic resins described above have dispersed therein a phosphorous containing compound which is substantially insoluble or immiscible in the nonpolar liquid at ambient temperatures and is selected from the group consisting of (1) polyphosphoric acids; (2) the +1 and +2 metal salts of said polyphosphoric acids; (3) phosphorous pentoxide; (4) pyrophosphate compounds of the general formula:

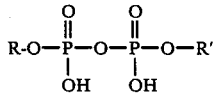

wherein R and R', which can be the same or different are alkyl of 1 to 10 carbon atoms; (5) the +1 and +2 metal salts of said pyrophosphates; (6) phosphonic acids of the general formula:

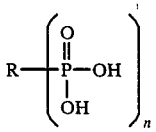

wherein R is alkyl of 1 to 30 carbon atoms and aryl of 6 to 30 carbon atoms, n is a whole number of 1 to 6; (7) the +1 and +2 metal salts of said phosphonic acids; (8) phosphate compounds of the general formula:

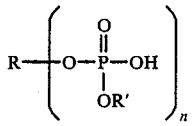

wherein R and R', which can be the same or different, are H, alkyl of 1 to 30 carbon atoms and aryl of 6 to 30 carbon atoms, n is whole number of 1 to 6; and (9) the +1 and +2 metal salts of said phosphate compounds, Suitable phosphorous containing compounds of the above types include:

| |
|---|
| (1) Polyphosphoric Acids and (2) +1 and +2 Metal Salts |
| Polyphosphoric acids of any molecular weight |
| Polyphosphoric acid, Na salt |
| Polyphosphoric acid, K salt |
| Polyphosphoric acid, Ba salt |
| (3) Phosphorous Pentoxide |
| (4) Pyrophosphates and (5) +1 and +2 Metal Salts |
| Pyrophosphate, tetrapotassium salt |
| Pyrophosphic acid |
| Disodium hydrogen pyrophosphate |
| Di-n-butylpyrophosphate |
| Di-ethylpyrophosphate |
| Diiosoctylpyrophosphate |
| Dimethylpyrophosphate |
| Adenosine 5-(alpha,beta-methylene)triphosphate, tetralithium salt, etc. |
| (6) Phosphonic Acids and (7) +1 and +2 Metal Salts |
| n-Dodecylphosphonic acid |
| Ethylphosphonic acid |
| Phenylphosphonic acid |
| n-Hexylphosphonic acid |
| n-Butylphosphonic acid |
| n-Decylphosphonic acid |
| n-Undecylphosphonic acid |
| n-Tridecylphosphonic acid |
| n-Tetradecylphosphonic acid |
| n-Pentadecylphosphonic acid |
| Propylene diphosphonic acid |
| N,N-bis(phosphonomethyl)glycine |
| 1,2-ethylenediphosphonic acid |
| Methylenediphosphonic acid |
| 1,1-ethylidenediphosphonic acid |
| Dimethylmethylenediphosphonic acid |
| Nitrilotris(methylene)triphosphonic acid |
| Ethylenediaminetetra(methylenetriphosphonic acid) |
| Hexamethylenediaminetetra(methylenetriphosphonic acid) |
| Diethylenetriaminepenta(methylenetriphosphonic acid) |
| Calcium, magnesium inositolhexaphosphate salt |
| (8) Phosphates and (9) +1 and +2 Metal Salts |
| Phosphoric acid |
| Mono-n-dodecyl phosphate |
| Tridecyl acid phosphate |
| Oleyl acid phosphate |
| Octadecyl acid phosphate |
| Di-n-amyl phosphate |
| Distearyl phosphate |
| n-Butyldihydrogen phosphate |
| Calcium dihydrogen phosphate |
| Aluminum dihydrogen phosphate |
| D-myo-inositol 1,4-biphosphate, potassium salt |
| (R,S)-(+,−)-1,1'-binaphthyl-2,2'-diylhydrogenphosphate |
| D-myo-inositol triphosphate, potassium salt |
| D-myo-inositol 1,3,4,5-tetraphosphate |
| D-myo-inositol pentaphosphate, barium salt |
| Inositol hexaphosphoric acid (phytic acid) |
| Sodium phyate |

The phosphorous containing compounds are present in the developer solids in an amount of 0.1 to 10 percent by weight, preferably 1 to 5 percent by weight based on the total weight of the developer solids. The method whereby the phosphorous-containing compounds are disposed in the thermoplastic resin is described below.

In addition, the resins have the following preferred characteristics:

1. Be able to disperse adjuvant, colorant, e.g., pigment,
2. Be insoluble in the dispersant liquid at temperatures below 40° C., so that the resin will not dissolve or solvate in storage,
3. Be able to solvate at temperatures above 50° C.,
4. Be able to be ground to form particles between 0.1 μm and 5 μm, in diameter (preferred size), e.g., determined by Horiba CAPA-500 centrifugal particle analyzer; and between 1 μm and 15 μm in diameter, e.g., determined by Malvern 3600E described below,
5. Be able to form a particle (average by area) of less than 10 μm, e.g., determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm, and about 30 μm average particle size, e.g., determined by Malvern 3600E Particle Sizer as described below, and
6. Be able to fuse at temperatures in excess 70° C.

By solvation in 3. above, the resins forming the toner particles will become swollen, gelatinous, or softened.

Suitable nonpolar liquid soluble ionic or zwitterionic charge director compounds (C) which are used in an amount of 0.1 to 10,000 mg/g, preferably 1 to 1,000 mg/g developer solids, include: positive charge directors, e.g., glyceride charge directors such as Emphos® D70-30C and Emphos F27-85, two commercial products sold by Witco Chemical Corp., New York, N.Y.; which are sodium salts of phosphated mono- and diglycerides with unsaturated and saturated acid substituents, respectively, lecithin, Basic Barium Petronate®, Neutral Barium Petronate®, Basic Calcium Petronate®, Neutral Calcium Petronate®, oil-soluble petroleum sulfonate, manufactured by Sonneborn Division of Witco Chemical Corp., NY, N.Y., etc.

As indicated above, additional components that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot® Mogul L (black pigment C.I. No. 77266) and Sterling® NS N 774 (Pigment Black 7, C.I. No. 77266).

Fine particle size oxides, e.g., silica, alumina, titania, etc.; preferably in the order of 0.5 μm or less can be dispersed into the liquefied resin. These oxides can be used alone or in combination with the colorants. Metal particles can also be added.

Another additional component of the electrostatic liquid developer is an adjuvant which can be selected from the group consisting of aminoalcohol, polybutylene succinimide and aromatic hydrocarbon having a Kauri-butanol value of greater than 30. The adjuvants are generally used in an amount of 1 to 1,000 mg/g, preferably 1 to 200 mg/g developer solids. Examples of the various above-described adjuvants include:

aminoalcohol compounds: triisopropanolamine, triethanolamine, ethanolamine, 3-amino-l-propanol, o-aminophenol, 5-amino-l-pentanol, tetra(2hydroxyethyl-)ethylenediamine, etc.;

polybutylene succinimide: OLOA®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.; and aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic® 100 which is a mixture of C9 and C10 alkyl-substituted benzenes manufactured by Exxon Corp., etc.

The particles in the electrostatic liquid developer have an average by area particle size of less than 10 μm, preferably the average particle size is less than 5 μm. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The positive electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary) are placed at least one of thermoplastic resin, dispersant liquid and phosphorous-containing compound described above. Generally the resin, phosphorous-containing compound, dispersant nonpolar liquid and optional colorant are placed in the vessel prior to starting the dispersing step. Optionally the colorant can be added after homogenizing the resin and the dispersant nonpolar liquid. Polar additive can also be present in the vessel, e.g., up to 100% based on the weight of polar additive and dispersant nonpolar liquid. The dispersing step is generally accomplished at elevated temperature, i.e., the temperature of ingredients in the vessel being sufficient to plasticize and liquefy the resin but being below that at which the dispersant nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner articles of proper size, configuration and morphology. Useful particulate media are particulate materials, e.g., spherical, cylindrical, etc. selected from the group consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar additive present until the desired dispersion is achieved, typically 2 hours with the mixture being fluid, the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media; or with stirring to form a viscous mixture and grinding by means of particulate media. Additional liquid may be added at any step during the preparation of the liquid electrostatic toners to facilitate grinding or to dilute the toner to the appropriate % solids needed for toning. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

Another instrument for measuring average particles sizes is a Malvern 3600E Particle Sizer manufactured by Malvern, Southborough, Mass. which uses laser diffraction light scattering of stirred samples to determine average particle sizes. Since these two instruments use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 + 3.4 |
| 20 | 6.4 + 1.9 |
| 15 | 4.6 + 1.3 |
| 10 | 2.8 + 0.8 |
| 5 | 1.0 + 0.5 |
| 3 | 0.2 + 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 15 percent by weight, preferably 0.3 to 3.0, and more preferably 0.5 to 2 weight percent with respect to the dispersant nonpolar liquid. One or more ionic or zwitterionic charge director compounds (C), of the type set out above, can be added to impart a positive charge. The addition may occur at any time during the process; preferably at the end of the process, e.g., after the particulate media, if used, are removed and the concentration of toner particles is accomplished. If a diluting dispersant nonpolar liquid is also added, the charge director compound can be added prior to, concurrently with, or subsequent thereto. It is believed that upon addition of the charge director compound some leaching of the phosphorous-containing compound into the dispersant nonpolar liquid occurs. If an adjuvant compound of a type described above has not been previously added in the preparation of the developer, it can be added prior to or subsequent to the developer being charged. Preferably the adjuvant compound is added after the dispersing step (A).

Two other process embodiments for preparing the electrostatic liquid developer include:

(A) dispersing a phosphorous-containing compound of the invention and optionally a colorant and/or adjuvant in a thermoplastic resin in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, thereby forming a dispersion of toner particles, (D) separating the dispersion of toner particles having an average by area particle size of less than 10 μm from the particulate media, (E) adding additional nonpolar liquid, polar liquid or combinations thereof to reduce the concentration of toner particles to between 0.1 to 15.0 percent by weight with respect to the liquid; and (F) adding to the dispersion a nonpolar soluble ionic or zwitterionic charge director compound; and (A) dispersing a phosphorous-containing compound of the invention and optionally a colorant and/or adjuvant in a thermoplastic resin in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, and optionally a colorant while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, and (F) adding additional nonpolar liquid, polar liquid or combinations thereof to reduce the concentration of toner particles to between 0.1 to 15.0 percent by weight with respect to the liquid; and (G) adding to the dispersion a nonpolar soluble ionic or zwitterionic charge director compound.

A preferred mode of the invention is described in Example 1.

INDUSTRIAL APPLICABILITY

The positive liquid electrostatic developers of this invention demonstrate improved image quality, resolution, solid area coverage (density), and toning of fine details, evenness of toning, and reduced squash independent of charge director or pigment present. The particles are exclusively charged positive. The developers of the invention are useful in copying, e.g., making office copies of black and white as well as various colors; or color proofing, e.g., a reproduction of an image using the standard colors: yellow, cyan, magenta together with black as desired; highlight color copying e.g., copying of two colors, usually black and a highlight color for letterheads, underlining, etc. In copying and proofing the toner particles are applied to a latent electrostatic image and can be transferred, if desired. Other uses envisioned for the positive liquid electrostatic developers include: digital color proofing, lithographic printing plates and resists.

EXAMPLES

The following controls and examples wherein the parts and percentages are by weight illustrate but do not limit the invention. In the examples the melt indices are determined by ASTM D 1238, Procedure A; and the average particle sizes by area were determined by a Malvern 3600 Particle Size Analyzer, or the Horiba CAPA 500 centrifugal particle analyzer; weight average molecular weight is determined by gel permeation chromatography (GPC).

Image quality of the toners of the invention was determined on a modified Savin 870 copier unless specifically noted. This device consists of a Savin 870 copier with the modifications described below.

Mechanical modifications include addition of a pretransfer corona and removing the anodized layer from the surface of the reverse roll while decreasing the diameter of the roll spacers to maintain the same gap between the roll and photoconductor.

Electrical modifications include:

(1) disconnecting the image density feedback loop from the development electrode and connecting the electrode to a Keithly high voltage supply (model 247), (Keithly, Cleveland, Ohio), (2) connecting a Keithly high voltage supply(model 247) to the modified reverse roll, (3) disconnecting the transfer corona and connecting same to a Trek (model 610) high voltage supply (Trek, Medina, N.Y.).

The modified Savin 870 was then used to evaluate both positive and negative toners depending on the voltages and biasses used. To evaluate positive toners the copier was run in a positive mode: reversed image target was used with negative transfer corona voltages and positive development bias. The reversed image target consists of white characters and lines, etc. on a black background.

The principal of operation is described below. The photoconductor is charged positive (near 1000V) by means of the charging corona. The copy is imaged onto the photoconductor inducing the latter to discharge to lower voltages (in order of increasing discharge-black areas and white areas). When adjacent to the toner electrode the photoconductor has fields at its surface such that positive toner will deposit at the white imaged areas, negative toner at the black imaged areas. If necessary toner background is cleaned by the biased reverse roll. The toner is then transferred to paper by the transfer corona (the transfer force due to the negative charge sprayed on the back of the paper). The toner is then thermally fused. Actual voltages and biases used can be found in the examples.

Table 1 contains toner formulation and performance information. Measurement results of the charge to mass ratio in micro Coulombs/gram (Q/m) for each toner are given. The toner Q/m ratios were measured with the following procedure: a light aluminum pan was weighed, placed on the spacers of the cell, and toner was then placed in the cell (filling the volume between the cell base and pan bottom, thickness 0.060 inch (1.52 mm)). A 180 pf capacitor is charged to 1000V, placed across the cell and a Keithly 616 Electrometer (Keithly, Cleveland, Ohio) was in series with the cell. The toner is deposited for 4 seconds. The total charge flow through the cell was measured on the electrometer which was proportional to the charge of the deposited toner. The pan with the deposited toner was removed from the cell, dried on a hot plate for about 20–30 minutes at 130° C., and the change in weight was recorded using a Mettler balance (AE100) (Mettler, Hightstown, N.Y.) accurate to 0.1 mg. Q/m is then calculated by the following formula: $Q/m = \Delta Q / \Delta m$. This process is repeated using a voltage of −1000 V to deposit toner particles with the opposite polarity. Q/m values are given with the sign of the toner particles. The +/ratio is the ratio of the weights of the deposited positive toner particles to the negative particles.

In the controls and examples, the following abbreviations are for the indicated adjuvants:

| | |
|---|---|
| BDHP | n-butyl dihydrogen phosphate |
| PPA | polyphosphoric acid |
| PA | phosphoric acid |
| PPABa | barium salt of polyphosphoric acid |
| PPANa | sodium salt of polyphosphoric acid |
| PPento | phosphorous pentoxide |
| DDPA | n-dodecylphosphonic acid |
| nDDP | mono-n-dodecylphosphate |
| EPA | ethylphosphonic acid |
| PhPA | phenylphosphonic acid |

CONTROL 1

In a Union Process IS Attritor, Union Process Company, Akron, Ohio, were placed the following ingredients:

| Ingredient | Amount (g) |
|---|---|
| Copolymer of ethylene (89%) and methacrylic acid (11%): melt index at 190 C. is 100, Acid number is 66 | 200.00 |
| Heucophthal Blue G XBT-583D Heubach, Inc., Newark NJ | 50.00 |
| Isopar ®-L, nonpolar liquid having a Kauri-butanol value of 27, Exxon Corporation | 1000.00 |

The ingredients were heated to 90° C. to 110° C. and milled at a rotor speed of 230 rpm with 0.1875 inch (4.76 mm) diameter stainless steel balls for 2 hours. The attritor was cooled to 42° C. to 50° C. while milling was continued and then 700 grams of Isopar ®-L(Exxon) was added. Milling was continued and the average particle size was monitored. Particle size measured with the Malvern 3600E Particle Sizer was 6.3 μm corresponding to a 16 hour cold grind. The particulate media were removed and the toner was diluted to 2% solids with additional Isopar ®-L and charged with 40 mg Basic Barium Petronate/g of toner solids resulting in conductivity of 25 pmhos/cm. Image quality was determined using a modified Savin 870 copier set up to evaluate positive toners.

The copier was run with a reversed image target and the following biases: development housing bias=+600V and transfer corona=−6 kV. Image quality was very poor with almost no discernable image. Image showed areas of reversed image indicating that the toner was negatively charged but there was not enough image to measure resolution. Q/m measurement also showed toner was negatively charged with Q/m=−92 and the ratio of the deposited positive particle weight/deposited negative particle weight was 0. Results are found in Tables 1 and 2 below.

CONTROL 2

The procedure of Control 1 was repeated with the following exceptions: no pigment was used. The toner was cold ground for 6 hours with final Malvern average particle size of 9.0 μm. The toner was diluted to 2% solids with additional Isopar ®-L and charged with 40 mg Basic Barium Petronate ®/g of toner solids resulting in conductivity of 28 pmhos/cm. Image quality was determined using a modified Savin 870 copier set up to evaluate negative toners. The copier was run with a standard image target and the following biases: development housing bias=+500V and transfer corona=+6 kV. Image quality showed poor image quality and that the toner was negatively charged. Q/m measurement also showed toner was negatively charged with Q/m=−159 and the ratio of the deposited positive particle weight/deposited negative particle weight was 0. Results are found in Tables 1 and 2 below.

CONTROL 3

In a Union Process 01 Attritor, Union Process Company, Akron, Ohio, were placed the following ingredients:

| Ingredient | Amount (g) |
|---|---|
| Terpolymer of methyl acrylate (67.3%) methacrylic acid (3.1%) and ethylhexyl acrylate (29.6%) weight average molecular weight of 172,000, acid no. is 13 | 35.0 |
| Uhlich Red Med, RD 2392 Paul Uhlich & Co., Hastings-On-Hudson, NY | 7.0 |
| Isopar ®-L (see Control 1) | 200.0 |

The ingredients were heated to 90° C. to 110° C. and milled with 0.1875 inch (4.76 mm) diameter stainless steel balls for 2 hours. The attritor was cooled to 42° C. to 50° C. while milling was continued. Milling was continued for 24.5 hours and the average particle size was 4.1 μm as measured on the Malvern instrument described in Control 1. The particulate media were removed and the dispersion of toner particles was then diluted to 2% solids with additional Isopar ®-L and a charge director such as Emphos ® D70-30C, sodium salt of phosphated mono- and diglycerides with acid substituents was added (200 mg Emphos ®/g of toner solids) resulting in conductivity of 24 pmho/cm. Image quality was determined using a modified Savin 870 copier set up to evaluate positive toners. The copier was run with a reversed image target and the following biases: development housing bias=+600V and transfer corona=−6 kV. Image quality showed a poor image and the toner was positively charged. Image showed no toning of solid areas, hollowed characters, 2–3 lp/mm, and image drag. Q/m measurement showed toner was negatively charged with Q/m=−205. Results are found in Tables 1 and 2 below.

CONTROL 4

The procedure of Control 3 was repeated with the following exceptions: 40 grams of a copolymer of ethylene (89%) and methacrylic acid (11%): melt index at 190° C. is 100, Acid number is 66 was used instead of the terpolymer of methyl acrylate (67.3%) methacrylic acid (3.1%) and ethylhexyl acrylate (29.6%). Instead of the Uhlich red pigment, 10.26 grams of Heucophthal Blue G XBT-583D, Heubach, Inc., Newark N.J. were used and instead of adding 200 grams of Isopar ®-L initially, 125 grams were added before the hot step and 125 grams were added after the hot step. In addition, 1.03 grams of n-butyl dihydrogen phosphate, Lancaster Synthesis, Windham, NH, were added. The toner was cold ground for 24 hours with final Malvern instrument average particle size of 11.8 μm. The toner was diluted to 2% solids with additional Isopar ®-L and charged with 40 mg. Basic Barium Petronate ®/g of toner solids resulting in conductivity of 9 pmhos/cm. The copier was run with a reversed image target and the following biases: development housing bias = +600V and transfer corona = −6 kV. Image quality was very poor and showed a reversed image indicating that the toner was negatively charged. Q/m measurement also showed toner was negatively charged with Q/m = −23.2 and the ratio of the deposited positive particle weight/deposited negative particle weight was 0. Results are found in Tables 1 and 2 below.

CONTROL 5

The procedure of Control 1 was repeated with the following exceptions: the toner was cold ground for 22 hours with final Malvern instrument average particle size of 5.7 μm. The toner was diluted to 2% solids with additional Isopar ®-L. Instead of charging with 40 mg. Basic Barium Petronate ®/g of toner solids, 0.8 gram of polyphosphoric acid, Aldrich Chemical Co., Milwaukee, Wis., was added to the finished developer resulting in conductivity of 0 pmho/cm. The copier was run with a reversed image target and the following biases: development housing bias = +600V and transfer corona = −6 kV. Image quality was poor: improved compared to Control 1 but much worse than Examples 1–5 below. The image was faint with low density, no toning of solid areas, and 8.5 lp/mm resolution. Q/m measurement showed toner was more negatively charged than positively charged with Q/m = −2.5 and the ratio of the deposited positive particle weights/deposited negative particle weight was 0.1. Results are found in Tables 1 and 2 below.

CONTROL 6

The procedure of Control 1 was repeated with the following exceptions: the toner was cold ground for 22 hours with final Malvern instrument average particle size of 5.7 μm. The toner was diluted to 2% solids with additional Isopar ®-L. The toner was charged with 40 mg Basic Barium Petronate ®/g of toner solids and 0.8 gram of polyphosphoric acid used in Control 5 was added to the finished developer resulting in conductivity of 30 pmhos/cm. The copier was run with a reversed image target and the following biases: development housing bias = +600V and transfer corona = −6 kV. Image quality was fair compared to Control 1 but showed that the toner was negatively charged. Q/m measurement also showed toner was negatively charged with Q/m = −88 and the ratio of the deposited positive particle weight/deposited negative particle weight was 0.03. Results are found in Tables 1 and 2 below.

EXAMPLE 1

The procedure of Control 1 was repeated with the following exceptions: 51.28 grams of Heucophthal Blue G XBT-583D were used instead of 50.00 grams. In addition 5.13 grams of Polyphosphoric acid used in Control 5 were initially present. The toner was cold ground for 15.5 hours with final Malvern average particle size of 4.2 μm. The toner was diluted to 2% solids with additional Isopar ®-L and charged with 40 mg Basic Barium Petronate ®/g of toner solids resulting in conductivity of 12 pmhos/cm. The copier was run with a reversed image target and the following biases: development housing bias = +200V and transfer corona = −6 kV. Image quality was very good and quite improved compared to Control 1 with 8.5 lp/mm resolution and good density. The image also indicated that the toner was positively charged. Q/m measurement also showed toner was positively charged with Q/m = +93 and the deposited negative particle weight was 0 Results are found in Tables 1 and 2 below.

EXAMPLE 2

The procedure of Control 3 was repeated with the following exceptions: 35 grams of a copolymer of ethylene (89%) and methacrylic acid (11%): melt index at 190° C. is 100, Acid number is 66 were used instead of the terpolymer of methyl acrylate (67.3%) methacrylic acid (3.1%) and ethylhexyl acrylate (29.6%). Instead of the Uhlich red pigment, 8.97 grams of Heucophthal Blue G XBT-583D, Heubach, Inc., Newark N.J. were used. Instead of adding 200 grams of Isopar ®-L initially, 125 grams were added before the hot step and 125 grams were added after the hot step. In addition, 1.06 grams of Phosphoric Acid (85%) Fisher Scientific, Pittsburgh, Pa., were added. The toner was cold ground for 16.5 hours with final Malvern instrument average particle size of 8.3 μm The toner was diluted to 2% solids with additional Isopar ®-L and charged with 40 mg Basic Barium Petronate ®/g of toner solids resulting in conductivity of 15 pmhos/cm. The copier was run with a reversed image target and the following biases: development housing bias = +200V and transfer corona = −6 kV. Image quality was good and quite improved compared to Control 1 with 8.5 lp/mm. Q/m measurement also showed toner was positively charged with Q/m = +65 and the deposited negative particle weight was 0. Results are found in Tables 1 and 2 below.

EXAMPLE 3

The procedure of Example 2 was repeated with the following exceptions: 0.90 gram of the barium salt of polyphosphoric acid was added instead of the phosphoric acid. The barium salt of polyphosphoric acid was prepared as follows: to a slurry of phosphorous pentoxide, J. T. Baker Chem. Co., Easton, Pa., 5.0 gm. in 5.0 gm. of mineral oil in a mortar was added 0.1 gram barium hydroxide octahydrate, Aldrich Chem. Co., Milwaukee, Wis., slowly with continuous vigorous mixing with the aid of a pestle. The resulting white slurry was washed well with hexane to remove the mineral oil yielding 4.0 gm. of the barium salt as an off-white paste. The toner was cold ground for 22 hours with final Malvern instrument average particle size of 7.7 μm. The toner was diluted to 2% solids with additional Isopar ®-L and charged with 40 mg Basic Barium Petronate ®/g of toner solids resulting in conductivity of 25 pmhos/cm. The copier was run with a reversed image target and the following biases: development housing bias = +600V and transfer corona = −6 kV. Image quality was good and quite improved compared to Control 1 with 8.5 lp/mm resolution and good density. Q/m measurement also showed toner was more positively than negatively charged with Q/m = +5670 and the ratio of the deposited positive particle weight/deposited negative particle weight was 1.5. Results are found in Tables 1 and 2 below.

EXAMPLE 4

The procedure of Example 3 was repeated with the following exceptions: 1.03 grams of the sodium salt of polyphosphoric acid were added instead of the barium salt of polyphosphoric acid. The sodium salt of polyphosphoric acid was prepared as follows: 18.3 grams of polyphosphoric acid, Aldrich Chem. Co., Milwaukee, Wis., were placed in a 500 ml flask equipped with mechanical stirrer and heated to 80° C. in an oil bath. To this was slowly added 4.6 grams powdered sodium hydroxide. The mixture was then heated and stirred for 4 hours which gave the sodium salt as a thick white paste. The toner was cold ground for 23.5 hours with final Malvern instrument average particle size of 7.8 μm. The toner was diluted to 2% solids with additional Isopar ®-L and charged with 40 mg Basic Barium Petronate ®/g of toner solids resulting in conductivity of 36 pmhos/cm. The copier was run with a reversed image target and the following biases: development housing bias = +600V and transfer corona = −6 kV. Image quality was good and quite improved compared to Control 1 with 6 lp/mm resolution and good density. Q/m measurement also showed toner was positively charged with Q/m = +413 and the ratio of the deposited positive particle weight/deposited negative particle weight was 6.8. Results are found in Tables 1 and 2 below.

EXAMPLE 5

The procedure of Example 3 was repeated with the following exceptions: 0.90 gram of phosphorous pentoxide, J. T. Baker Chem. Co., Easton, Pa. was added instead of the barium salt of polyphosphoric acid. The toner was cold ground for 21 hours with final Malvern instrument average particle size of 8.0 μm. The toner was diluted to 2% solids with additional Isopar ®-L and charged with 40 mg Basic Barium Petronate ®/g of toner solids resulting in conductivity of 3 pmhos/cm after equilibration for about one month. The copier was run with a reversed image target and the following biases: development housing bias = +600V and transfer corona = −6 kV. Image quality was good and quite improved compared to Control 1 with 8.5 lp/mm resolution and good density. Q/m measurement also showed toner was positively charged with Q/m = +66 and the deposited negative particle weight was 0. Results are found in Tables 1 and 2 below.

EXAMPLE 6

The procedure of Example 3 was repeated with the following exceptions: 0.82 gram of polyphosphoric acid, Aldrich Chemical Co., Milwaukee, Wis., was added instead of the barium salt of polyphosphoric acid and no pigment was used. The toner was cold ground for 23.5 hours with final Malvern instrument average particle size of 8.0 μm. The toner was diluted to 2% solids with additional Isopar ®-L and charged with 40 mg Basic Barium Petronate ®/g of toner solids resulting in conductivity of 22 pmhos/cm. The copier was run with a reversed image target and the following biases: development housing bias = +600V and transfer corona = −6 kV. Image quality was good and quite improved compared to Control 2 with 6–8 lp/mm. The image also showed that the toner was positively charged. Q/m measurement showed toner was more positively charged than negatively charged with Q/m = +243 and the ratio of the deposited positive particle weight/deposited negative particle weight was 2.1. Results are found in Tables 1 and 2 below.

EXAMPLE 7

The procedure of Control 3 was repeated with the following exceptions: 0.7 gram of polyphosphoric acid, Aldrich Chemical Co., Milwaukee, Wis., was also added at the beginning of the hot dispersion step. The toner was cold ground for 24 hours with final Malvern instrument average particle size of 6.0 μm. The toner was diluted to 2% solids with additional Isopar ®-L and charged with 200 mg. Emphos ® D70–30C described in Control 3/g of toner solids resulting in conductivity of 38 pmhos/cm. The copier was run with a reversed image target and the following biases: development housing bias = +600V and transfer corona = −6 kV. Image quality was fair and improved compared to Control 3 with 4–6 lp/mm resolution and improved solids. The image also indicated that the toner was positively charged. Q/m measurement also showed toner was positively charged with Q/m = +4403 and the deposited negative particle weight was 0. Results are found in Tables 1 and 2.

EXAMPLE 8

The procedure of Control 4 was repeated with the following exceptions: 35 grams of resin were used instead of 40 grams, 8.97 grams of Heucophthal Blue G XBT-583D were used instead of 10.26 grams and 0.90 gram of n-dodecylphosphonic acid was used instead of n-butyl dihydrogen phosphate. The toner was cold ground for 25 hours with final Malvern instrument average particle size of 7.5 μm. The toner was diluted to 2% solids with additional Isopar ®-L and charged with 40 mg Basic Barium Petronate ®/g of toner solids resulting in conductivity of 11 pmhos/cm. The copier was run with a reversed image target and the following biases: development housing bias = +1000V and transfer corona = −6 kV. Image quality was fair and improved compared to Control 1 with 8.5 lp/mm resolution. The image indicated that the toner was positively charged. Q/m measurement also showed toner was more positively charged than negatively charged with Q/m = +141.8 and the ratio of the deposited positive particle weight/deposited negative particle weight was 0.8. Results are found in Tables 1 and 2 below.

EXAMPLE 9

The procedure of Example 8 was repeated with the following exceptions: mono-n-dodecylphosphate, Alpha Products, Morton Thiokol Co., Danvers, Mass., was used instead of n-dodecylphosphonic acid. The toner was cold ground for 19.5 hours with instrument average particle size of 7.2 μm. The toner was diluted to 2% solids with additional Isopar ®-L and charged with 40 mgs Basic Barium Petronate ®/g of toner solids resulting in conductivity of 15 pmhos/cm. The copier was run with a reversed image target and the following biases: development housing bias = +600V and transfer corona = −6 kV. Image quality was very good and quite improved compared to Control 1 with 8.5 lp/mm resolution and good density. The image indicated that the toner was positively charged. Q/m measurement also showed toner was positively charged with Q/m = +68.8 and the ratio of the deposited positive particle weight/deposited negative particle weight was 25. Results are found in Tables 1 and 2 below.

EXAMPLE 10

The procedure of Example 8 was repeated with the following exceptions: ethylphosphonic acid, Alfa Products, Morton Thiokol Co., Danvers, Mass. was used instead of n-dodecylphosponic acid. The toner was cold ground for 29.5 hours with final Malvern instrument average particle size of 6.8 μm. The toner was diluted to 2% solids with additional Isopar ®-L and charged with 40 mgs Basic Barium Petronate ®/g of toner solids resulting in conductivity of 3 pmhos/cm. The copier was run with a reversed image target and the following biases: development housing bias = +600V and transfer corona = −6 kV. Image quality was fair and improved compared to Control 1 with 8.5 lp/mm resolution. The image indicated that the toner was positively charged. Q/m measurement also showed toner was positively charged with Q/m = +10 and the ratio of the deposited positive particle weight/deposited negative particle weight was 172. Results are found in Tables 1 and 2 below.

EXAMPLE 11

The procedure of Example 8 was repeated with the following exceptions: phenylphosphonic acid, Alfa Products, Morton Thiokol Co., Danvers, Mass., was used instead of n-dodecylphosphonic acid. The toner was cold ground for 21 hours with final Malvern instrument average particle size of 6.3 μm. The toner was diluted to 2% solids with additional Isopar ®-L and charged with 40 mg Basic Barium Petronate ®/g of toner solids resulting in conductivity of 7 pmhos/cm. The copier was run with a reversed image target and the following biases: development housing bias = +600V and transfer corona = −6 kV. Image quality was fair and improved compared to Control 1 with 8.5 lp/mm resolution. The image indicated that the toner was positively charged. Q/m measurement also showed toner was positively charged with Q/m = +59 and the ratio of the deposited positive particle weight-/deposited negative particle weight was 7. Results are found in Tables 1 and 2 below.

TABLE 1

| Control or Example | Adjuvant | Cond (pmhos/cm) | Q/m (microcoulombs/g) |
|---|---|---|---|
| C1 | — | 25 | −92 |
| C2 | — | 28 | −159 |
| C3 | — | 24 | −205 |
| C4 | BDHP | 9 | −23.2 |
| C5 | PPA* | 0 | −2.5 |
| C6 | PPA* | 30 | −88 |
| E1 | PPA | 12 | +93 |
| E2 | PA | 15 | +65 |
| E3 | PPABa | 25 | +5670 |
| E4 | PPANa | 36 | +413 |
| E5 | PPentO | 3 | +66 |
| E6 | PPA | 22 | +243 |
| E7 | PPA | 38 | +4403 |
| E8 | DDPA | 11 | +141.8 |
| E9 | nDDP | 15 | +68.8 |
| E10 | EPA | 3 | +10 |
| E11 | PhPA | 7 | +59 |

*Added after dilution.

TABLE 2

| Control or Example | Adjuvant | lp/mm | Solubility of Phosphorous Containing Compound in Isopar ® at Ambient Temperature |
|---|---|---|---|
| C1 | V. Poor | — | — |
| C2 | Poor | — | — |
| C3 | Poor | — | — |
| C4 | V. Poor | — | Immisc. |
| E1 | V. Good | 8.3 | Immisc. |
| E2 | V. Good | 8.5 | Immisc. |
| E3 | Good | 8.5 | Insol. |
| E4 | Good | 6.0 | Insol. |
| E5 | Fair | 8.5 | Insol. |
| E6 | Fair | 6–8 | Immisc. |
| E7 | Fair | 4–6 | Immisc. |
| E8 | Fair | 8.5 | Insol. |
| E9 | Good | 8.5 | Insol. |
| E10 | Fair | 8.5 | Immisc. |
| E11 | Fair | 8.5 | Insol. |

We claim:

1. An improved positive electrostatic liquid developer having improved charging characteristics consisting essentially of (A) a nonpolar liquid having a Kauributanol value of less than 30, present in a major amount, (B) thermoplastic resin particles having dispersed therein 0.1 to 10 percent by weight based on the total weight of developer solids of a phosphorous-containing compound which is substantially insoluble or immiscible in the nonpolar liquid at ambient temperatures and is selected from the group consisting of (1) polyphosphoric acids; (2) the +1 and +2 metal salts of said polyphosphoric acids; (3) phosphorous pentoxide; (4) pyrophosphate compounds of the general formula:

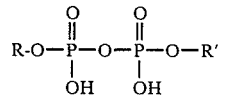

wherein R and R′, which can be the same or different are alkyl of 1 to 10 carbon atoms; (5) the +1 and +2 metal salts of said pyrophosphates; (6) phosphonic acids of the general formula:

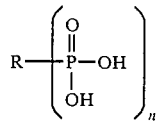

wherein R is alkyl of 1 to 30 carbon atoms and aryl of 6 to 30 carbon atoms, n is a whole number of 1 to 6; (7) the +1 and +2 metal salts of said phosphonic acids; (8) phosphate compounds of the general formula:

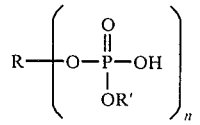

wherein R and R′, which can be the same or different, are H, alkyl of 1 to 30 carbon atoms and aryl of 6 to 30 carbon atoms, n is whole number of 1 to 6;

and (9) the +1 and +2 metal salts of said phosphate compounds, the resin particles having an average by area particle size of less than 10 μm, and (C) a nonpolar liquid soluble ionic or zwitterionic charge director compound.

2. A positive, liquid electrostatic developer according to claim 1 wherein the phosphorous-containing compound is a polyphosphoric acid.

3. A positive, liquid electrostatic developer according to claim 1 wherein the phosphorous-containing compound is a +1 or +2 metal salt of a polyphosphoric acid.

4. A positive, liquid electrostatic developer according to claim 1 wherein the phosphorous-containing compound is phosphorous pentoxide.

5. A positive, liquid electrostatic developer according to claim 1 wherein the phosphorous-containing compound is of the general formula:

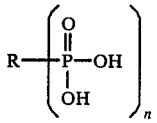

wherein R is alkyl of 1 to 30 carbon atoms and aryl of 6 to 30 carbon atoms, and n is a whole number of 1 to 6.

6. A positive, liquid electrostatic developer according to claim 5 wherein the phosphorous-containing compound is n-dodecylphosphonic acid.

7. A positive liquid electrostatic developer according to claim 1 wherein the phosphorous-containing compound is of the general formula:

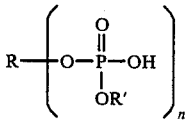

wherein R and R′, which can be the same or different, are H, alkyl of 1 to 30 carbon atoms and aryl of 6 to 30 carbon atoms, and n is a whole number of 1 to 6.

8. A positive, liquid electrostatic developer according to claim 1 wherein component (A) is present in 85 to 99.9% by weight, based on the total weight of liquid developer, the total weight of developer solids to 15.0% by weight, and component (C) is present in an amount of 0.1 to 10,000 mg/g developer solids.

9. A positive, liquid electrostatic developer according to claim 1 containing up to about 60 percent by weight of a colorant based on the total weight of developer solids.

10. A positive, liquid electrostatic developer according to claim 9 wherein the colorant is a pigment.

11. A positive, liquid electrostatic developer according to claim 1 wherein no colorant is present.

12. A positive, liquid electrostatic developer according to claim 1 wherein an additional compound is present which is an adjuvant selected from the group consisting of aminoalcohol, polybutylene succinimide, and aromatic hydrocarbon.

13. A positive, liquid electrostatic developer according to claim 9 wherein an additional compound is present which is an adjuvant selected from the group consisting of aminoalcohol, polybutylene succinimide, and an aromatic hydrocarbon.

14. A positive liquid electrostatic developer according to claim 13 wherein an aminoalcohol adjuvant compound is present.

15. A positive, liquid electrostatic developer according to claim 13 wherein a polybutylene succinimide adjuvant compound is present.

16. A positive, liquid electrostatic developer according to claim 13 wherein an aromatic hydrocarbon adjuvant compound is present.

17. A positive, liquid electrostatic developer according to claim 14 wherein the aminoalcohol adjuvant compound is triisopropanolamine.

18. A positive, liquid electrostatic developer according to claim 1 wherein the thermoplastic resin is a copolymer of ethylene and an alpha,betaethylenically unsaturated acid selected from the group consisting of acrylic acid and methacrylic acid.

19. A positive, liquid electrostatic developer according to claim 1 wherein the thermoplastic resin is a terpolymer of methylacrylate/methacrylic acid/ethylhexyl acrylate.

20. A positive, liquid electrostatic developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

21. A positive, liquid electrostatic developer according to claim 9 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (9 to 20%).

22. A positive, liquid electrostatic developer, according to claim 20 wherein the thermoplastic resin is a copolymer of ethylene (89%)/methacrylic acid (11%) having a melt index at 190° C. of 100.

23. A positive, liquid electrostatic developer according to claim 1 wherein the particles have an average by area particle size of less than 5 μm.

24. A positive, liquid electrostatic toner according to claim 1 wherein component (C) is an oil-soluble petroleum sulfonate.

25. A positive, liquid electrostatic toner according to claim 1 wherein component (C) is lecithin.

26. A process for preparing a positive, liquid electrostatic developer for electrostatic imaging comprising (A) dispersing at an elevated temperature in a vessel a thermoplastic resin, 0.1 to 10 percent by weight based on the total weight of developer solids of a phosphorous-containing compound which is substantially insoluble or immiscible in a nonpolar liquid at ambient temperatures as is selected from the group consisting of (1) polyphosphoric acids; (2) the +1 and +2 metal salts of said polyphosphoric acids; (3) phosphorous pentoxide; (4) pyrophosphate compounds of the general formula:

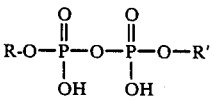

wherein R and R′, which can be the same or different are alkyl of 1 to 10 carbon atoms; (5) the +1 and +2 metal salts of said pyrophosphates; (6) phosphonic acids of the general formula:

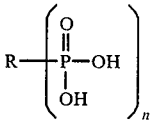

wherein R is alkyl of 1 to 30 carbon atoms and aryl of 6 to 30 carbon atoms, n is a whole number of 1 to 6; (7) the +1 and +2 metal salts of said phosphonic acids; (8) phosphate compounds of the general formula:

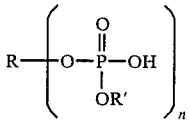

wherein R and R′, which can be the same or different, are H, alkyl of 1 to 30 carbon atoms and aryl of 6 to 30 carbon atoms, n is whole number of 1 to 6; and (9) the +1 and +2 metal salts of said phosphate compounds, a dispersant nonpolar liquid having a Kauri-butanol value of less than 30, and a colorant, while maintaining the temperature in the vessel at a temperature sufficient to plasticize and liquify the resin and below that at which the dispersant nonpolar liquid degrades and the resin and/or colorant decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate with or without the presence of additional liquid; or (3) while grinding by means of particulate media to prevent the formation of a gel or solid mass with or without the presence of additional (C) separating the dispersion of thermoplastic toner particles having an average by area particle size of less than 10 μm from the particulate media, and (D) adding to the dispersion (during or subsequent to Step (A)) a nonpolar liquid soluble ionic or zwitterionic charge director compound.

27. A process according to claim 26 wherein the phosphorous-containing compound is a polyphosphoric

28. A process according to claim 26 wherein the phosphorous-containing compound is a +1 or +2 metal salt of a polyphosphoric acid.

29. A process according to claim 26 wherein the phosphorous-containing compound is phosphorous pentoxide.

30. A process according to claim 26 wherein the phosphorous-containing compound is of the general formula:

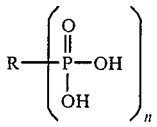

wherein R is alkyl of 1 to 30 carbon atoms and aryl of 6 to 30 carbon atoms, n is a whole number of 1 to 6.

31. A process according to claim 30 wherein the phosphorous-containing compound is n-dodecylphosphonic acid.

32. A process according to claim 26 wherein the phosphorous-containing compound is of the general formula:

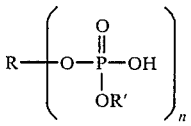

wherein R and R′, which can be the same or different, are H, alkyl of 1 to 30 carbon atoms and aryl of 6 to 30 carbon atoms, n is a whole number of 1 to 6.

33. A process according to claim 26 wherein there is present in the vessel up to 100% by weight of a polar additive having a Kauri-butanol value of at least 30, the percentage based on the total weight of the liquid in the developer.

34. A process according to claim 26 wherein the particulate media are selected from the group consisting of stainless steel, carbon steel, ceramic, alumina, zirconium, silica and sillimanite.

35. A process according to claim 26 wherein the thermoplastic resin is a copolymer of ethylene and an alpha,beta-ethylenically unsaturated acid selected from the group consisting of acrylic acid and methacrylic acid.

36. A process according to claim 26 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

37. A process acording to claim 36 wherein the thermoplastic resin is a copolymer of ethylene (89%) methacrylic acid (11%) having a melt index at 190° C. of 100.

38. A process according to claim 26 wherein the ionic or zwitterionic compound is an oil-soluble petroleum sulfonate.

39. A process according to claim 26 wherein the ionic or zwitterionic compound is lecithin.

40. A process according to claim 26 wherein additional dispersant nonpolar liquid, polar liquid, or combinations thereof is present to reduce the concentration of toner particles to between 0.1 to 15 percent by weight with respect to the liquid.

41. A process according to claim 40 wherein the concentration of toner particles is reduced by additional dispersant nonpolar liquid.

42. A process according to claim 26 wherein cooling the dispersion is accomplished while grinding by means of particulate media to prevent the formation of a gel or solid mass with or without the presence of additional liquid.

43. A process according to claim 26 wherein cooling the dispersion is accomplished without stirring to form a gel or solid mass, followed by shredding the gel or solid mass and grinding by means of particulate media with or without the presence of additional liquid.

44. A process according to claim 26 wherein cooling the dispersion is accomplished with stirring to form a viscous mixture and grinding by means of particulate media with or without the presence of additional liquid.

45. A process according to claim 26 wherein an adjuvant compound selected from the group consisting of aminoalcohol, polybutylene succinimide, and an aromatic hydrocarbon is added.

46. A process according to claim 45 wherein the adjuvant compound is an aminoalcohol.

47. A process according to claim 46 wherein the aminoalcohol is triisopropanolamine.

48. A process according to claim 40 wherein an adjuvant compound selected from the group consisting of aminoalcohol, polybutylene succinimide, and an aromatic hydrocarbon is added to the liquid developer.

49. A process according to claim 26 wherein no colorant is present.

50. A process for preparing a positive liquid electrostatic developer for electrostatic imaging comprising (A) dispersing 0.1 to 10 percent by weight based on the total weight of developer solids of a phosphorous-containing compound which is substantially insoluble or immiscible in a nonpolar liquid at ambient temperatures and is selected from the group consisting of (1) polyphosphoric acids; (2) the +1 and +2 metal salts of said polyphosphoric acids; (3) phosphorous pentoxide; (4) pyrophosphate compounds of the general formula:

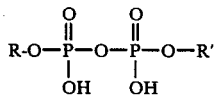

wherein R and R', which can be the same or different are alkyl of 1 to 10 carbon atoms; (5) the +1 and +2 metal salts of said pyrophosphates; (6) phosphonic acids of the general formula:

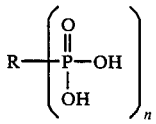

wherein R is alkyl of 1 to 30 carbon atoms and aryl of 6 to 30 carbon atoms, n is a whole number of 1 to 6; (7) the +1 and +2 metal salts of said phosphonic acids; (8) phosphate compounds of the general formula:

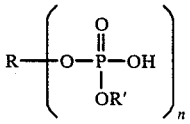

wherein R and R', which can be the are H, alkyl of 1 to 30 carbon atoms and aryl of 6 to 30 carbon atoms, n is whole number of 1 to 6; and (9) the +1 and +2 metal salts of said phosphate compounds in a thermoplastic resin in the absence of a dispersant nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, thereby forming a dispersion of toner particles, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15.0 percent by weight with respect to the liquid; and (F) adding to the dispersion a liquid soluble ionic or zwitterionic compound.

51. A process according to claim 50 wherein a colorant is present in step (A).

52. A process for preparing a positive, electrostatic liquid developer for electrostatic imaging comprising (A) dispersing 0.1 to 10 percent by weight based on the total weight of developer solids of a phosphorous-containing compound which is substantially insoluble or immiscible in a nonpolar liquid at ambient temperatures and is selected from the group consisting of (1) polyphosphoric acids; (2) the +1 and +2 metal salts of said polyphosphoric acids; (3) phosphorous pentoxide; (4) pyrophosphate compounds of the general formula:

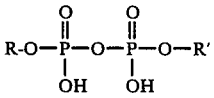

wherein R and R', which can be the same or different are alkyl of 1 to 10 carbon atoms; (5) the +1 and +2 metal salts of said pyrophosphates; (6) phosphonic acids of the general formula:

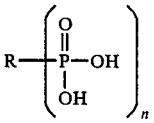

wherein R is alkyl of 1 to 30 carbon atoms and aryl of 6 to 30 carbon atoms, n is a whole number of 1 to 6; (7) the +1 and +2 metal salts of said phosphonic acids; (8) phosphate compounds of the general formula:

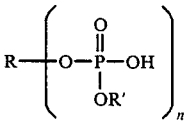

wherein R and R', which can be the same or different, are H, alkyl of 1 to 30 carbon atoms and aryl of 6 to 30 carbon atoms, n is whole number of 1 to 6; and (9) the +1 and +2 metal salts of said phosphate compounds in a thermoplastic resin in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (D) cooling the dispersion, either (1) without stirring to form a gel or solid mass, followed by shredding the gel or solid mass and grinding by means of particulate media with or without the presence of additional liquid, (2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 $\mu$m from the particulate media, and (F) adding additional nonpolar liquid, polar liquid or combinations thereof to reduce the concentration of toner particles to between 0.1 to 15.0 percent by weight with respect to the liquid; and (G) adding to the dispersion a liquid soluble ionic or zwitterionic compound.

53. A process according to claim 52 wherein a colorant is present in step (C).

* * * * *